US007461492B1

(12) United States Patent
Francies, III et al.

(10) Patent No.: US 7,461,492 B1
(45) Date of Patent: Dec. 9, 2008

(54) DECK CONNECTOR

(75) Inventors: Sidney E. Francies, III, Lithia, FL (US); Richard J. Beak, Tampa, FL (US); Cliff Friend, Tampa, FL (US); Dewey W. Turbeville, Tampa, FL (US)

(73) Assignee: MMI Management Services LP, Houston, TX (US)

( * ) Notice: Subject to any disclaimer, the term of this patent is extended or adjusted under 35 U.S.C. 154(b) by 193 days.

(21) Appl. No.: 11/517,847

(22) Filed: Sep. 8, 2006

Related U.S. Application Data

(60) Provisional application No. 60/727,175, filed on Oct. 14, 2005.

(51) Int. Cl.

| | |
|---|---|
| ***E04B 1/38*** | (2006.01) |
| ***E04B 2/00*** | (2006.01) |
| ***E04B 1/18*** | (2006.01) |
| ***E04C 5/00*** | (2006.01) |
| ***E04C 3/00*** | (2006.01) |
| ***E04C 3/30*** | (2006.01) |
| ***E02D 35/00*** | (2006.01) |
| ***E02D 27/00*** | (2006.01) |
| ***E02D 27/32*** | (2006.01) |
| ***E04G 21/14*** | (2006.01) |
| ***E04H 12/34*** | (2006.01) |

(52) U.S. Cl. ..... 52/704; 52/125.5; 52/295; 52/285.1; 52/582.1; 52/578; 52/587.1; 52/125.4; 52/698; 52/414; 52/432

(58) Field of Classification Search ..... 52/578, 52/587.1, 125.4, 698, 704, 414, 432, 125.5, 52/295, 285.1, 582.1, 583.1
See application file for complete search history.

(56) References Cited

U.S. PATENT DOCUMENTS

| | | | | | |
|---|---|---|---|---|---|
| 668,366 | A | * | 2/1901 | Wight | 52/582.1 |
| 1,199,077 | A | * | 9/1916 | James | 249/210 |
| 1,280,485 | A | | 10/1918 | Kahn | |
| 1,659,326 | A | * | 2/1928 | Meyercord | 52/307 |
| 2,110,863 | A | * | 3/1938 | Barnett | 52/101 |
| 2,621,378 | A | * | 12/1952 | Wilson | 52/578 |
| 3,460,860 | A | * | 8/1969 | Stevens, Jr. | 52/584.1 |
| 3,563,582 | A | | 2/1971 | Shroyer et al. | |
| 3,958,954 | A | | 5/1976 | Ehlenbeck | |
| 3,993,341 | A | * | 11/1976 | Bentley | 294/89 |
| 4,123,882 | A | | 11/1978 | Case et al. | |
| 4,145,152 | A | | 3/1979 | Waugh | |
| 4,445,303 | A | * | 5/1984 | Judkins | 52/98 |
| 4,724,649 | A | | 2/1988 | Lowndes, III | |
| 5,222,338 | A | | 6/1993 | Hull et al. | |
| 5,307,603 | A | * | 5/1994 | Chiodo | 52/698 |
| 5,402,616 | A | | 4/1995 | Klein | |
| 5,618,125 | A | | 4/1997 | McPhee | |
| 5,623,804 | A | | 4/1997 | Kelly et al. | |
| 5,651,911 | A | | 7/1997 | Pennypacker | |
| 5,890,340 | A | * | 4/1999 | Kafarowski | 52/704 |
| 5,971,662 | A | | 10/1999 | Becker | |
| 6,145,262 | A | * | 11/2000 | Schrader et al. | 52/396.02 |

(Continued)

*Primary Examiner*—Brian E. Glessner
*Assistant Examiner*—Ryan J Franks
(74) *Attorney, Agent, or Firm*—David W. Pettis, Jr.

(57) ABSTRACT

A deck connector that may be cast into a structural concrete element for use in joining adjacent ones of the concrete elements to each other by the use of weld plates that are movably disposed within a weld plate housing forming an element of each of the deck connectors.

16 Claims, 3 Drawing Sheets

U.S. PATENT DOCUMENTS

| | | | | |
|---|---|---|---|---|
| 6,185,897 | B1 | 2/2001 | Johnson et al. | |
| 6,298,619 | B1 * | 10/2001 | Davie | 52/293.3 |
| 6,354,760 | B1 | 3/2002 | Boxall et al. | |
| 6,389,772 | B2 * | 5/2002 | Gleckman et al. | 52/582.1 |
| 6,460,824 | B1 * | 10/2002 | Lancelot et al. | 249/91 |
| 6,645,342 | B2 | 11/2003 | Scott | |
| 6,647,674 | B1 | 11/2003 | Lancelot, III et al. | |
| 6,668,506 | B2 | 12/2003 | Snauwaert | |
| 6,681,538 | B1 | 1/2004 | Sarkisian | |
| 6,755,385 | B2 | 6/2004 | Lancelot, III et al. | |
| 6,761,007 | B2 | 7/2004 | Lancelot, III et al. | |
| 6,764,249 | B2 | 7/2004 | Stone | |
| 6,810,633 | B2 | 11/2004 | Harris, Sr. | |
| 6,854,232 | B2 | 2/2005 | Snauwaert | |
| 7,124,550 | B1 * | 10/2006 | Deming | 52/745.21 |
| 2002/0096619 | A1 * | 7/2002 | Lancelot et al. | 249/91 |
| 2002/0192018 | A1 * | 12/2002 | Snauwaert | 403/286 |
| 2003/0033778 | A1 * | 2/2003 | Boxall et al. | 52/396.02 |
| 2003/0101678 | A1 * | 6/2003 | Snauwaert | 52/712 |
| 2003/0110728 | A1 | 6/2003 | Pacione et al. | |
| 2003/0140590 | A1 * | 7/2003 | Lancelot et al. | 52/712 |
| 2004/0010985 | A1 | 1/2004 | Francies, III et al. | |
| 2007/0056242 | A1 * | 3/2007 | Sample | 52/698 |
| 2007/0231068 | A1 * | 10/2007 | Francies et al. | 404/56 |

* cited by examiner

DECK CONNECTOR

PRIORITY CLAIM

Applicants claim the benefit of their prior Provisional Application, Ser. No. 60/727,175, filed Oct. 14, 2005, and titled IMPROVED DECK CONNECTOR.

BACKGROUND OF THE INVENTION

1. Field of the Invention

The present invention relates to an improved construction for deck connectors. The connectors of this invention basically comprise a metal piece that is cast into the edge of a concrete slab or tee, and a void is provided and defined by a box disposed behind the connector in the slab and communicating with a slot formed through the face of the connector. A plate dowel is movably disposed within the box, through the slot formed in the connector whereby adjacent concrete structural members may be joined by welding opposed plate dowels.

2. Description of the Prior Art

In the construction industry the use of flange connectors for the purpose of connecting adjacent concrete slabs and wall panels is certainly well-known. One early example of such prior art devices is provided in U.S. Pat. No. 3,958,954, to Ehlenbeck. According to the teaching of that patent, the connector is embedded along the edges of concrete members, and is formed of sheet metal that includes an elongated central portion which is exposed for the purpose of welding adjacent connectors on opposed panels.

Yet another form of such a connector is taught in U.S. Pat. No. 5,402,616, to Klein. Still another teaching in the patent literature is provided by U.S. Pat. No. 6,185,897, to Johnson, et al. All three of the prior art devices identified in the above patents provide a substantially flat metal surface exposed on the edge of the concrete element and a pair of angularly-extending legs into the concrete element, those legs extending back into the concrete from the exposed planar weldment face. The actual connection between adjacent slabs and connectors is performed by either welding the exposed faces to each other, or, more commonly, inserting a bar or slug between the faces and accomplishing the welding connection.

The prior art also teaches that the use of plate dowels between such concrete structures may be advantageous in that such plate dowels may be inserted into a pocket so that the slabs may move horizontally to minimize the size and number of restraint cracks. However, the prior art neither discloses nor suggests any structure whereby the utility of a plate dowel may be combined with state-of-the-art connectors.

It is therefore clear that an improved deck connector, suitable for use in combination with a form of plate dowel, would represent a significant improvement in the construction of various structures utilizing precast/prestressed slabs and wall panels. Of course, for purposes of economy and utility, any such improved connector must be suitable for installation as the slabs are formed and easily accessible as the structure is erected. For purposes of safety, the connections formed using the improved connector must satisfy all applicable codes and standards.

SUMMARY OF THE INVENTION

The present invention relates to an improved deck connector of the type used in the construction industry for joining adjacent concrete structures in an edge-to-edge or edge-to-vertical relationship. The improved connector basically comprises a bent metal anchor that is embedded into the concrete structural element as it is formed. The connector further comprises a plastic box or housing that receives a metal weld plate, preferably having a pull tab attached thereto. The invention further comprises a void former that is held over the exposed surface of the metal connector as the concrete element is formed. The void former is preferably held in place by magnets and is removed for use, as more fully set forth hereinafter.

The invention accordingly comprises the features of construction, combination of elements, and arrangement of part which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 1:
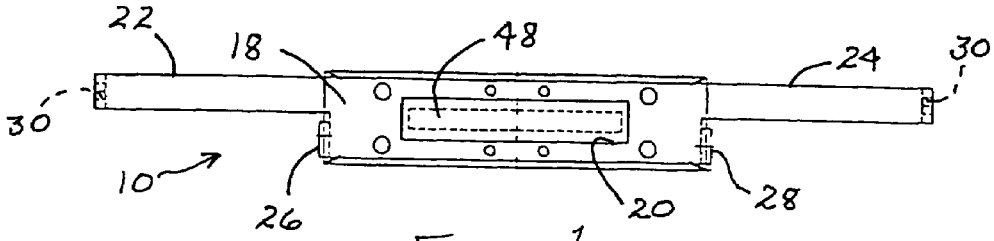
FIG. 1 is a front elevation view of the bent metal anchoring device, with the flat metal weld plate indicated in broken lines.
Figure 2:
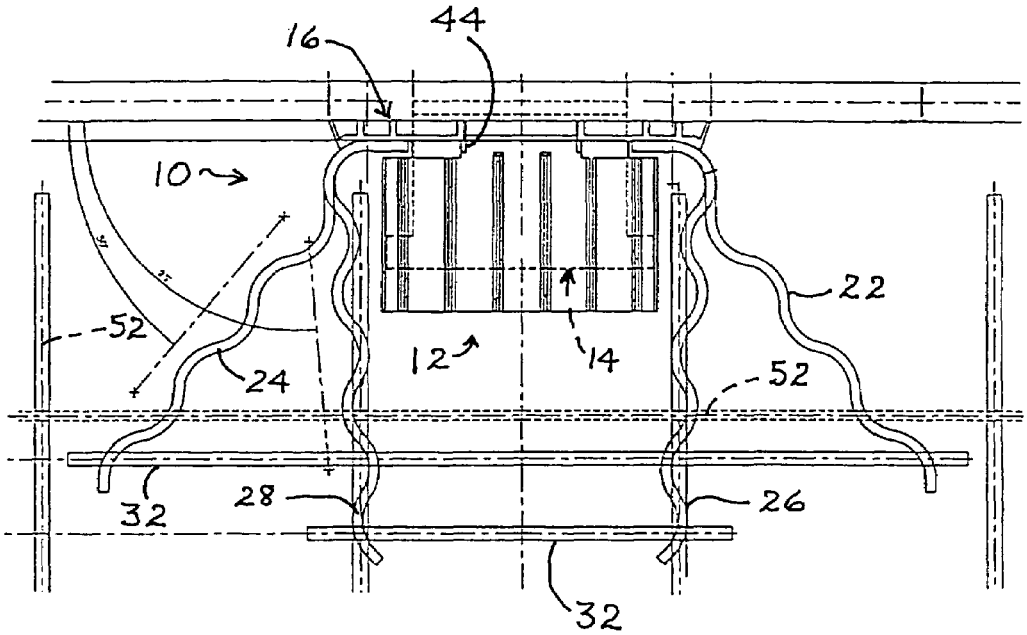
FIG. 2 is a top plan view illustrating placement of the improved connector within a concrete slab and including reinforcing mesh and anchor bars.
Figure 3:
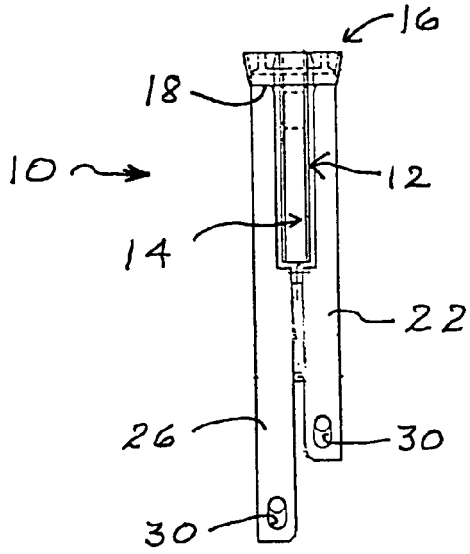
FIG. 3 is a right side view of the improved deck connector of this invention.
Figure 4:
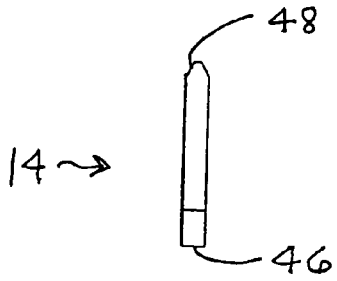
FIG. 4 is a side view of a preferred embodiment for the metal weld plate.
Figure 5:
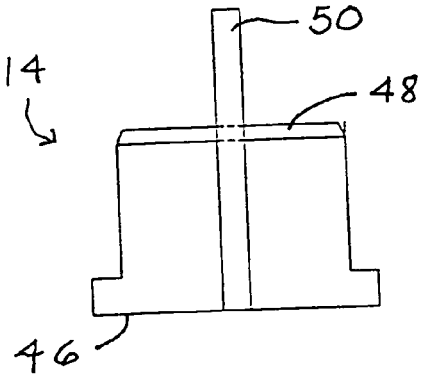
FIG. 5 is a top plan view of the weld plate of FIG. 4, and shows the addition of a pull tab.
Figure 6:
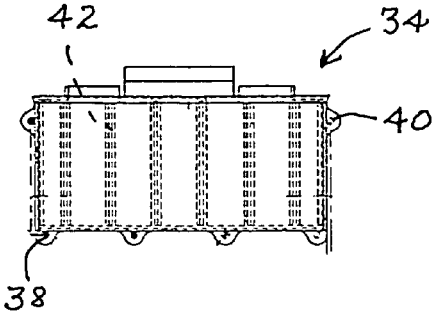
FIG. 6 is as top plan view of the top half of the weld plate box or housing, depicting internal ridges in broken lines.
Figure 7:
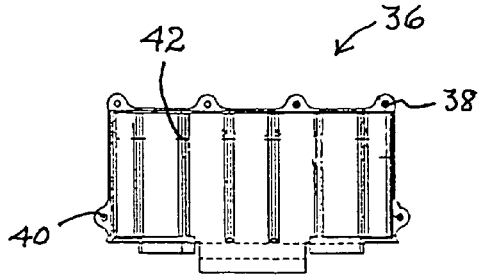
FIG. 7 is an inside plan view of the bottom half of the weld plate box or housing.
Figure 8:
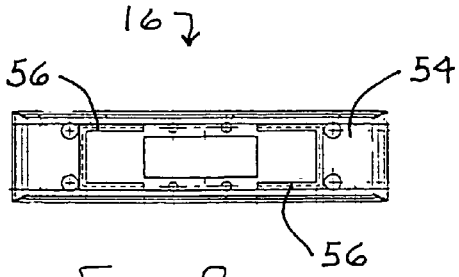
FIG. 8 is a front elevation of the void former.
Figure 9:
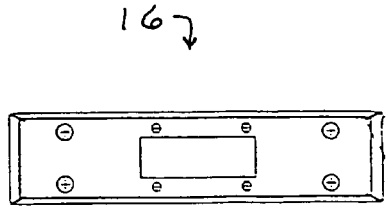
FIG. 9 is a rear elevation of the void former.

A preferred embodiment for the improved deck connector of this invention is shown in drawing FIGS. 1-9. The invention basically comprises a bent metal anchoring device, generally indicated as 10 in the views of FIGS. 1-3. A plastic box or housing, generally indicated as 12 in the views of FIGS. 2, 6 and 7, is provided rearwardly of the anchoring device 10, and a flat metal weld plate, generally indicated as 14 in the views of FIGS. 4 and 5, is mounted within box 12. Finally, a void former, generally indicated as 16 in the views of FIGS. 2, 8 and 9, is removably attachable to the front of anchoring device 10.

Attention is first invited to the view of FIG. 2, wherein the improved deck connector of this invention is shown as it might be typically placed within a concrete slab as the slab is formed. Metal anchoring device 10 may be stamped and formed from a sheet of metal stock, preferably steel. The anchoring device 10 includes a substantially planar front face 18 having a rectangular opening 20 formed therein. On each side of front face 18 the metal stock is split to form four legs, defined by upper legs 22 and 24 and lower legs 26 and 28. As indicated in the views of FIGS. 1 and 2, each of the upper legs 22 and 24 are bent rearwardly from front face 18 to define an angle of about 50 degrees with respect to the plane defined by front plate front face 18. Each of the lower legs 26 and 28 are similarly bent rearwardly, and preferably define an angle of about 95 degrees with respect to the plane defined by front face 18. In the view of FIG. 2 one can see that all legs 22, 24, 26 and 28 are further formed in a wave-like manner. Finally, at the distal end of each of the legs 22-28 a leg aperture 30 is formed.

Both the angular orientation of legs 22-28 and the wave-like bending of each of those legs significantly enhance the security of anchoring device 10 within the concrete slab. Additional security of anchoring device 10 within the concrete may be accomplished by the insertion of reinforcing bars 32 through opposed leg apertures 30 in the upper legs 22 and 24, and the opposed leg apertures 30 in each of the lower legs 26 and 28. However, the use of reinforcing bars 32 is considered optional.

The plastic box or housing 12 is also shown in the view of FIG. 2, and is disposed on the back side of front face 18. Referring to the views of FIGS. 6 and 7, it can be seen that the box 12 is preferably formed from a top half, generally indicated as 34 in the view of FIG. 6, and a bottom half generally indicated as 36 in the view of FIG. 7. Box 12 is preferably formed from plastic and each of the halves 34 and 36 comprise opposed, mating male tabs 38 and female receivers 40 whereby the halves 34 and 36 may be snapped together. One can also see that each of the halves 34 and 36 include a plurality of ridges 42 formed on the interior thereof. Finally, a box opening 44 is provided, and box opening 44 is in registry with rectangular opening 20 formed in front face 18 of anchoring device 10. Attention is invited to the fact that box opening 44 is centered on the face of box 12 and is smaller than the horizontal dimension (width) defined by the interior of box 12.

Movably mounted within box 12 is weld plate 14. As clearly seen in the view of FIG. 5, weld plate 14 defines a horizontal dimension (width) at its rear edge 46 that is greater than the horizontal dimension (width) defined by beveled front edge 48. Rear edge 46 is wider than the corresponding width of box opening 44, and beveled front edge 48 is slightly less than the corresponding dimension of box opening 44. Thus, beveled front edge 48 of weld plate 14 may be withdrawn from box 12, using pull tab 50, thereby extending outwardly from box 12 and through rectangular opening 20 to position beveled front edge 48 of weld plate 14 for its intended use of connecting to an adjacent anchoring device 10 in an adjacent concrete structure. Pull tab 50 would then simply be removed.

The provision of the ridges 42 on the interior of box 12 serves as guides or runners for weld plate 14. The substantially T-shape of weld plate 14 prevents its removal from anchoring device 10, while still permitting adjustment of its position with respect to an adjacent anchoring device 10 in a second concrete structure to which attachment is desired. The beveled structure defined by front edge 48 of weld plate 14 further enhances the ease with which a connection can be made. It is to be understood that a welding slug or bar is not required, but may be used. It is also to be understood that, for purposes of economy, the opposed anchoring device in the second concrete structure may be constructed to define a continuous front face, having no rectangular opening 20, no box or housing 12, and no weld plate 14. That second device would, however, include upper legs 22 and 24 and lower legs 26 and 28 as described above. If such a modified anchoring device were used, in the second concrete structure, weld plate 14 as described above could be welded directly to the modified front face of the modified anchoring device.

While the preferred method of connecting adjacent anchoring devices is by welding opposed weld plates 14 as described above, or by welding weld plate 14 to the modified face of the modified anchoring device, other means for accomplishing the connection are also contemplated. For example, the front edge of opposed weld plates may be modified to define correspondingly opposed relieved portions, or steps such that opposed modified weld plates would actually overlap each other when withdrawn from their respective boxes 12 for attachment. Physical attachment could then be accomplished by welding, or even by the placement of bolts through apertures formed in the opposed ledges.

Referring once again to the view of FIGS. 2 and 3, it should be noted that leg apertures 30 are preferably of an oval configuration and that each of the upper legs 22 and 24 are preferably disposed above reinforcing mesh 52 while lower legs 26 and 28 are preferably disposed below reinforcing mesh 52.

According to known forming techniques, it is necessary to "protect" what will be the exposed front face 18 of anchoring device 10 as the concrete is poured and allowed to set. This "protection" is accomplished by the use of void former 16. Referring to the view of FIG. 8, one can see that void former front face 54 comprises opposed, substantially U-shaped ridges 56 thereon. While attachment of void former 16 to anchoring device 10 may be accomplished by any suitable, standard means for removal after the structure has been formed, the preferred attachment is by placing magnets within the area defined by U-shaped ridges 56.

Clearly, then, the improved deck connector of this invention represents a significant advance over the current state of the art. The structure of metal anchoring device 10 enhances the "capture" of the connector within the concrete structure, particularly if reinforcing bars 32 are utilized. Box or housing 12 into which the weld plate 14 is mounted is easily assembled because of its two-part, snap-together structure, and the shape of weld plate 14 literally eliminates the possibility of the plate being lost by falling out during transportation or installation. Furthermore, because weld plate 14 is free to move on the ridges 42 formed within box 12, the connector of this invention is suitable for use across joints of from about zero (0) to about 1.5 inches in width. Even once the connection has been made, weld plate 14 may still "move" to accommodate expansion and contraction of the joined structure without transferring stress to the concrete. Finally, because the weld plate 14 does not come into contact with either surrounding concrete or anchoring device 10, heat resulting from the welding operation more easily dissipates and is not directly transferred to the structure. This significantly reduces the likelihood of cracking or splintering during the connection process. While it may be viewed as relatively minor, the addition of the removable pull tab 50 to weld plate 14 significantly enhances the ease with which the weld plate 14 may be withdrawn for connection. Finally, the utility of the improved deck connector of this invention is enhanced by the fact that anchoring device 10 may be formed using known cutting and stamping techniques from flat stock and that box or housing 12 may be formed with extreme economy by plastic molding.

It will thus be seen that the objects set forth above, among those made apparent from the preceding description, are efficiently attained and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An improved deck connector of the type that is typically cast into concrete members so that adjacent ones of the concrete members may be joined, said deck connector comprising: an anchor comprising a substantially planar front face and an opposed rear face, a perimeter of said front and rear faces being defined by a top edge, a bottom edge, a right side, and a left side, an opening formed through said front face and said rear face, and a plurality of legs extending from said right side and said left side of said front and said rear faces; a weld plate housing disposed adjacent said rear face of said anchor, said weld plate housing comprising a top half and a bottom half, said top half and said bottom half being attachable to each other to define a void therebetween, said weld plate housing further comprising a slot formed therein in communicating relation to said void and said slot being disposed in registry with said opening of said anchor; a weld plate movably disposed within said void, said weld plate comprising a front edge dimensioned and configured to extend through said slot of said weld plate housing and said opening of said anchor, wherein said weld plate defines a substantially T-shaped perimeter, said front edge being defined by a distal end of the leg of said T-shape, and a width defined by the longitudinal dimension of the top bar of said T-shape being greater than a corresponding dimension of said slot of said weld plate housing, whereby said front edge of said weld plate may be disposed outwardly from said front face of said anchor.

2. An improved deck connector as in claim 1 further comprising a void former removably attachable to said front face of said anchor.

3. An improved deck connector as in claim 1 wherein said plurality of legs comprises an upper leg and a lower leg, one of said upper legs and said lower legs extending from each of said right and left sides of said front and said rear faces of said anchor, respectively.

4. An improved deck connector as in claim 3 wherein each of said upper legs defines an acute angle with respect to the plane defined by said front face, and wherein each of said lower legs defines an obtuse angle with respect to the plane defined by said front face.

5. An improved deck connector as in claim 4 wherein said acute angles is about 50° and said obtuse angle is about 95°.

6. An improved deck connector as in claim 4 wherein each of said upper and said lower legs comprises a distal end remote from said front face and a leg aperture formed through each of said distal ends.

7. An improved deck connector as in claim 4 wherein each of said upper and said lower legs is deformed to define a substantially sinusoidal configuration when viewed from a plane normal to the plane defined by said front face.

8. An improved deck connector as in claim 1 wherein said top half and said bottom half of said weld plate housing each comprise a plurality of ridges formed thereon and extending inwardly toward said void, each one of said plurality of ridges defining a longitudinal dimension that is substantially normal to the plane defined by said front face.

9. An improved deck connector as in claim 8 wherein said top half and said bottom half of said weld plate housing are removably attachable to each other.

10. An improved deck connector as in claim 8 wherein said weld plate housing is formed from plastic and said top half and said bottom half are removably attachable to each other.

11. An improved deck connector as in claim 1 wherein said distal end of said leg of said T-shape is beveled.

12. An improved deck connector as in claim 1 further comprising a pull tab attached to said leg of said T-shape, a segment of said pull tab extending through said slot and said opening outwardly from said front face of said anchor.

13. An improved deck connector as in claim 1 further comprising a pull tab attached to said weld plate, a segment of said pull tab extending through said slot and said opening outwardly from said front face of said anchor.

14. An improved deck connector as in claim 2 wherein said anchor is formed from a ferrous material and wherein said void former comprises a rear side that is disposed adjacent said front face of said anchor and an opposed front side, said front side of said void former comprising at least one magnet receiver formed thereon, said void former further comprising a magnet disposed in said magnet receiver, whereby said void former may be removably attached to said front face of said anchor.

15. An improved deck connector as in claim 14 wherein said magnet receiver is defined by a substantially U-shaped perimeter extending outwardly from said front side of said void former, said magnet being dimensioned and configured to be received within said perimeter.

16. An improved deck connector as in claim 14 comprising a plurality of said magnet receivers formed in spaced apart relation on said front side of said void former and a corresponding plurality of said magnets, each one of said magnets being dimensioned and configured to be received within a corresponding one of said magnet receivers.

* * * * *